US005292256A

United States Patent [19]

Brunker et al.

[11] Patent Number: 5,292,256

[45] Date of Patent: * Mar. 8, 1994

[54] HIGH SPEED GUARDED CAVITY BACKPLANE CONNECTOR

[75] Inventors: David L. Brunker; Philip J. Dambach, both of Naperville; Frank A. Harwath, Downers Grove; Joseph W. Nelligan, Jr., LaGrange Park; Robert M. Petrie, Glen Ellyn, all of Ill.

[73] Assignee: Molex Incorporated, Lisle, Ill.

[ * ] Notice: The portion of the term of this patent subsequent to Jun. 1, 2010 has been disclaimed.

[21] Appl. No.: 3,199

[22] Filed: Jan. 11, 1993

Related U.S. Application Data

[62] Division of Ser. No. 878,803, May 5, 1992, Pat. No. 5,215,473.

[51] Int. Cl.[5] ..... H01R 13/652

[52] U.S. Cl. ..... 439/108; 439/607

[58] Field of Search ..... 439/101, 108, 607-610

[56] References Cited

U.S. PATENT DOCUMENTS

| | | | |
|---|---|---|---|
| 4,148,543 | 4/1979 | Shores | 439/608 |
| 4,451,107 | 5/1984 | Dola et al. | 439/608 |
| 4,781,604 | 11/1988 | Sadigh-Behzadi et al. | 439/608 |
| 4,917,616 | 4/1990 | Demler, Jr. et al. | 439/101 |
| 5,066,236 | 11/1991 | Broeksteeg | 439/79 |
| 5,088,937 | 2/1992 | Gabany | 439/581 |
| 5,141,453 | 8/1992 | Fusselman et al. | 439/108 |

FOREIGN PATENT DOCUMENTS

| | | | |
|---|---|---|---|
| 254385 | 1/1988 | European Pat. Off. | 439/108 |

*Primary Examiner*—Gary F. Paumen
*Attorney, Agent, or Firm*—A. A. Tirva

[57] ABSTRACT

A backplane signal connector assembly includes a header connector adapted for mounting on a backplane and a receptacle connector adapted for mounting on a daughter printed circuit board. Each connector includes a conductive housing having a cavity for receiving at least two signal terminals and at least one ground terminal. The signal terminal has an insert molded insulating mounting body about a portion thereof to provide a module for mounting in the cavity to insulate the terminal from the conductive housing. The ground terminal is in direct conductive engagement with the housing. The terminals are stamped and formed metal components. At least one ground clip is mounted on each conductive housing in direct conductive engagement therewith and is adapted for commoning to a ground on the respective backplane and daughter printed circuit board, whereby the housing establishes a primary ground reference for the connector.

11 Claims, 7 Drawing Sheets

HIGH SPEED GUARDED CAVITY BACKPLANE CONNECTOR

This is a divisional of copending application Ser. No. 07/878,803 filed on May 5, 1992, now U.S. Pat. No. 5,215,473 issued Jun. 1, 1993.

FIELD OF THE INVENTION

This invention generally relates to the art of electrical connectors and, particularly, to a backplane signal connector of the modular type, such as connectors for connecting a daughter printed circuit board to a mother printed circuit board.

BACKGROUND OF THE INVENTION

In the electronic industry, such as in the field of computers, banks of removable printed circuit boards, commonly known as daughter boards, are removably connected to associated circuitry such as other printed circuit boards, commonly known as mother boards. Such banks of removable circuit boards often require connectors arranged in closely spaced rows along with rows of terminals in the respective connectors. The terminals are interconnected between circuit traces on the daughter boards and circuit traces on the mother boards. Often, the circuit traces terminate at rows of plated-through holes in the boards, and the terminals in the connectors have rows of pins soldered to the plated-through holes. The connectors are removably mateable for easy replacement of a daughter board.

Backplane connectors of the character described above may be used in significant numbers in a single electronic device, such as a computer. Consequently, the connectors could contribute significantly to the costs of the circuitry for the device. Additionally, present day computers require the use of increasingly higher speed switching signals or higher application frequencies in the use of analog systems which generate an increasing amount of electromagnetic interference (EMI) necessitating in the introduction of coaxial type connectors to interconnect the boards while keeping EMI at a minimum. Such coaxial connectors typically take up excessive board space, have been designed of undue complexity, and involve a multiplicity of components in case of right angle connectors, some of the individual components, themselves, being expensive to fabricate. For instance, the terminals of some connectors are fabricated by expensive machining operations and an individual coaxial cavity must be associated with each discrete signal to be communicated. In addition, such connectors in certain operations must take into consideration the provision of component designs which control impedance, cross-talk between the terminals, appropriate ground referencing, and the like. All of these parameters may contribute to the complexity of backplane connectors heretofore available.

This invention is directed to such problems and to satisfying the need for a relatively low cost, easily manufactured connector of the character described above, to interconnect high speed transmission circuits in a backplane environment of an electronic apparatus.

SUMMARY OF THE INVENTION

In accordance with the present invention to overcome the foregoing problems, we provide a "guarded cavity" connector design as an economic solution to the need for an interconnect system capable of providing high speed signal transfer with low cross-talk, low levels of electromagnetic leakage, controlled impedance and maintenance of a high level of signal fidelity.

The guarded cavity design lends itself to the mass-production techniques of stamping, forming and molding. It is suitable for many of the applications which previously required coaxial type connectors. Where coaxial connectors require an individual conductive cavity to house each individual signal conductor (or signal pair in the case of differential pair transmission), the proposed guarded cavity solution requires only one conductive cavity to house multiple signal conductors or conductor pairs. Signal conductors which are meant for transmission of discrete signals are "guarded" from interference with the other signal conductors by the interposition of grounded "guard" contacts between discrete signal conductors or signal conductor pairs.

The guarded cavity design, as shown schematically in FIG. 13, maintains low levels of electromagnetic leakage by providing a substantially closed conductive cavity for the containment of electromagnetic radiation. As shown in FIG. 3, the outer conductive housing 58 provides a primary ground reference for signal conductors 72 and 70 disposed within the cavity and held within a molded portion 76. The dimensions of the outer housing and signal conductors are such that capacitance between the signal conductors to the outer housing is greater than the capacitance between the two signal conductors even in the absence of a ground contact 74. The ground contact 74 is an electrostatic guard which is interposed between the signal conductors 70 and 72 to virtually eliminate any small amounts of capacitance which would otherwise electrically link signal contacts 70 and 72 with each other. The ground contact 74 also is configured to communicate electrically and thereby to ground to the outer conductive housing 58 via resilient tabs 74c which contact the outside housing on both sides of ground contacts 74 to minimize any voltage gradients which may otherwise occur between the ground and the outer conductive cavity. In this fashion, the ground contact 74 acts as a guard between signal members 70 and 72 and not as a source of reradiation.

The guarded cavity construction makes possible high density interconnection of high speed electrical signals within a single containment cavity. Such an arrangement allows for an assembly containing two or more signal members and the respective interposing ground contacts to be mass loaded in a comb-like arrangement into a single conductive cavity and to provide a level of performance similar to many discrete coaxial contacts.

In the exemplary embodiment of the invention, a backplane connector assembly is disclosed to include a header connector adapted for mounting on a backplane and a receptacle connector adapted for mounting on a daughter printed circuit board. Each connector is similarly designed and constructed.

Specifically, each connector includes a conductive housing having cavity means for receiving at least two signal terminals and at least one ground terminal. At least the signal terminals are insert molded at least in part by an insulating mounting body to provide a module for mounting in the cavity means to insulate the terminals from the conductive housing. The ground terminal is in direct conductive engagement with the housing within the cavity means. The terminals are efficiently and inexpensively stamped and formed metal components. At least one ground clip is mounted on the conductive housing in direct conductive engagement therewith and is adapted for commoning to a ground on the respective backplane and daughter printed circuit board, whereby the housing establishes a primary ground reference for the connector.

In the illustrated embodiment of the invention, each connector includes two signal terminals arranged with the ground terminal therebetween, along with two ground clips arranged with one ground clip outside each signal terminal thereby to substantially shield the signal terminals in a given plane. The conductive housing extends along the sides of the plane, thereby to substantially shield the entire terminal array.

In one embodiment of the invention, two signal terminals respectively are insert molded by an insulating mounting body to provide two separate modules, with the ground terminal being in direct conductive engagement with the conductive housing. In another embodiment of the invention, two signal terminals are provided, with the signal terminals and the ground terminal all being insert molded by a common insulating body to provide a single module, and with the ground terminal having a portion projecting beyond the body for directly engaging a wall of the housing, such as provided by a grounding cantilevered spring arm.

The conductive housing of each connector is disclosed herein as a die cast metal component. A feature of the invention contemplates the employment of a conductive grounding gasket means disposed between and commoning the conductive housings of the connectors when the connectors are assembled.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION

Figure 1:
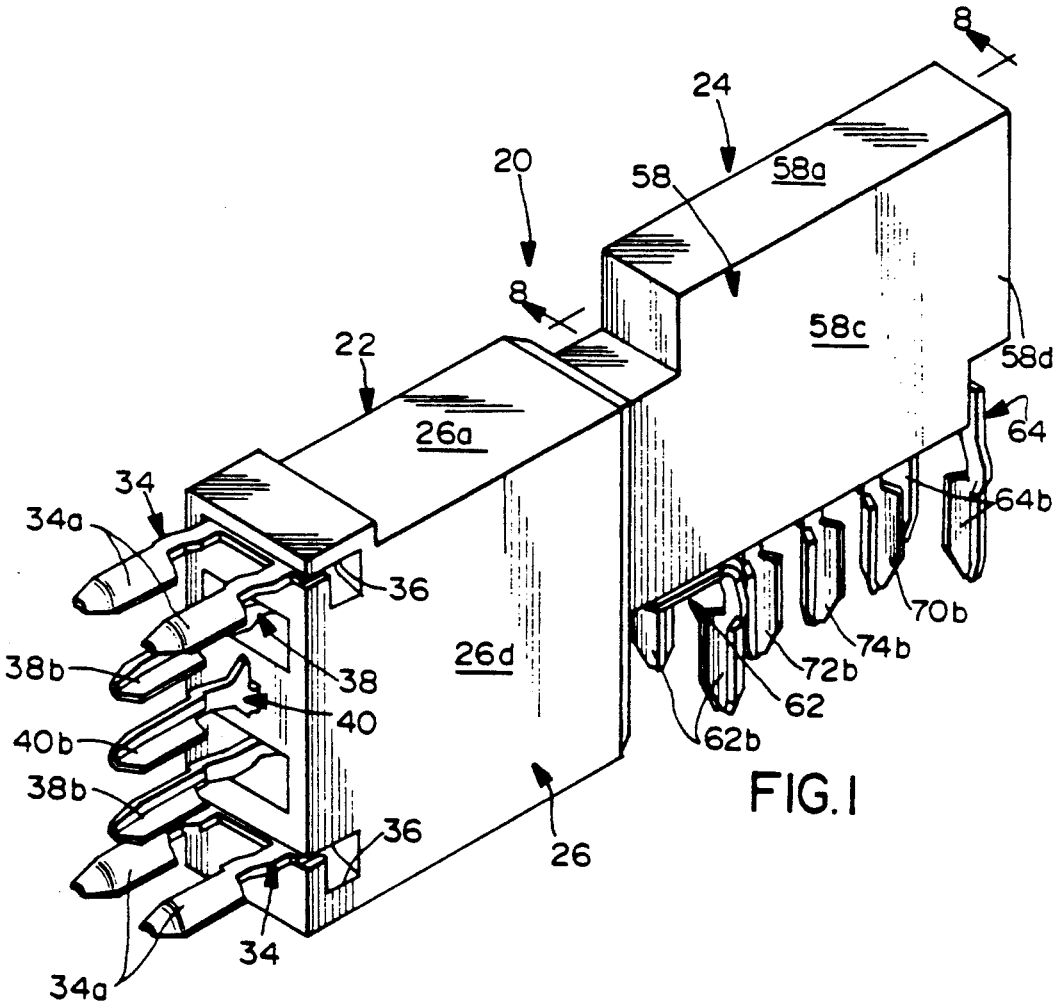
FIG. 1 is a perspective view of a backplane signal connector assembly incorporating the concepts of the invention.

Referring to the drawings in greater detail and first to FIG. 1, the invention is disclosed in a backplane signal connector assembly, generally designated 20, which includes a header connector, generally designated 22, which is adapted for mounting on a backplane, and a receptacle connector, generally designated 24, which is adapted for mounting on a daughter printed circuit board. Of course, it should be understood that the concepts of the invention are equally applicable for other uses of the connector assembly 20, as well as the individual header connector 22 and receptacle connector 24, wherein the connectors are adapted for interconnecting other electronic components.

Generally, as will be described in detail hereinafter, each of header connector 22 and receptacle connector 24 are similarly designed and constructed. Each connector includes a conductive housing having cavity means for receiving at least two signal terminals and at least one ground terminal. The terminals are stamped and formed metal components. In the preferred embodiment, the terminals are arranged in a generally planar array. At least one of the signal terminals is insert molded at least in part by an insulating mounting body to provide a module for mounting in the cavity means of the conductive housing to insulate the terminal from the housing. At least one ground clip is mounted on the conductive housing in conductive engagement therewith and is adapted for commoning to a ground on the respective backplane and daughter printed circuit board or on other appropriate electronic components. Therefore, the housing establishes a primary ground reference for either header connector 22 or receptacle connector 24 or, in fact, for the entire header connector 20. Die casting the housing, stamping and forming the terminals and ground chips, and insert molding at least some of the terminals to provide modules, all contribute to a less complex and relatively inexpensive connector which is readily adapted for automated assembly.

Figure 2:
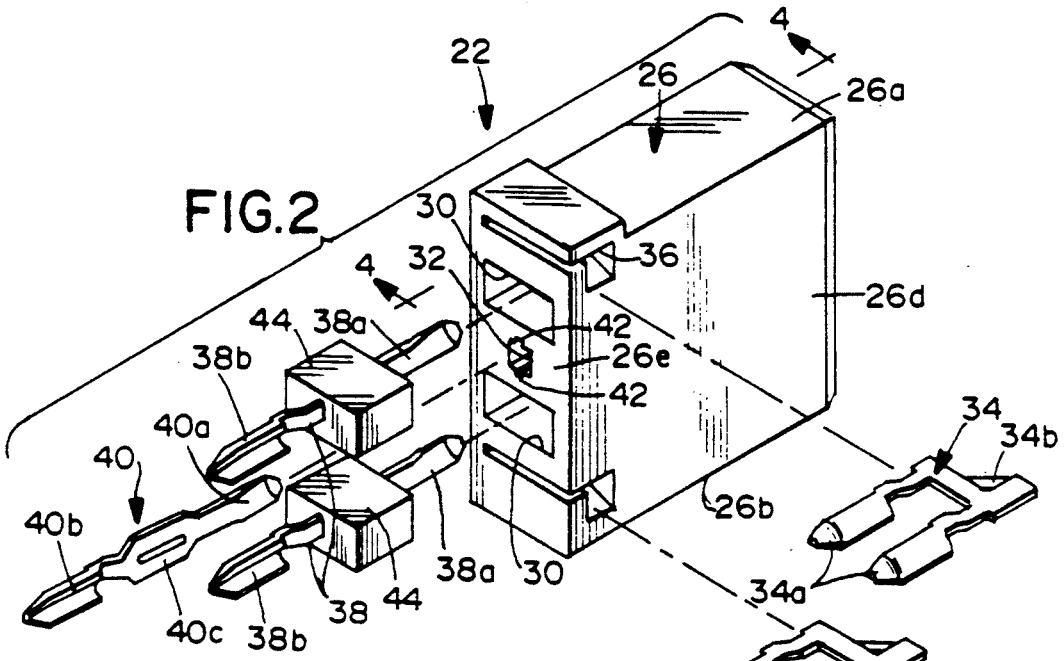
FIG. 2 is an exploded perspective view of the components of the header connector of the assembly.
Figure 3:
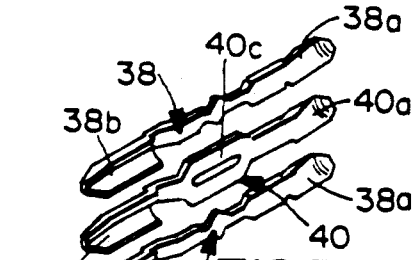
FIG. 3 is a perspective view of the signal and ground terminals of the header connector.
Figure 4:
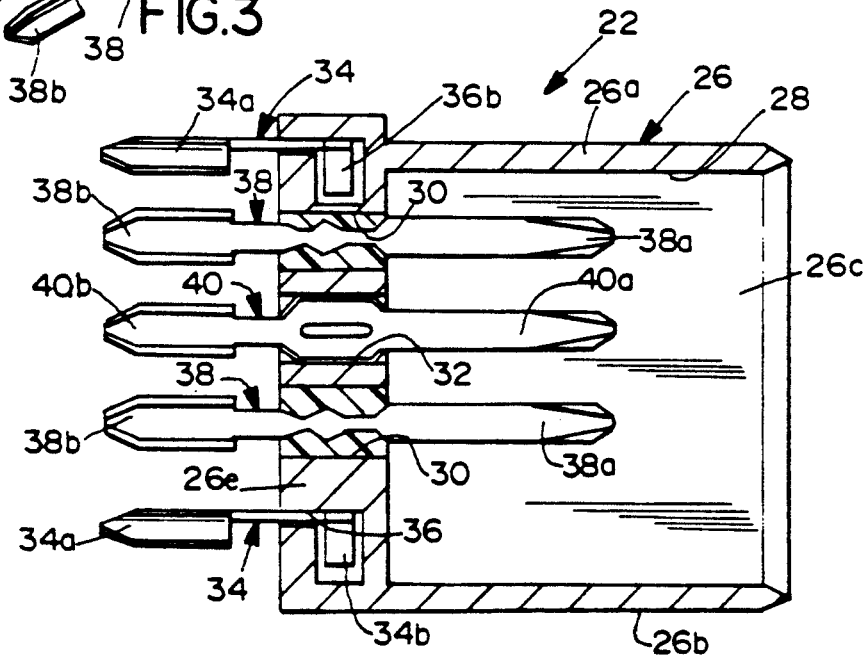
FIG. 4 is a vertical section through the header connector, taken generally in the direction of arrows 4—4 in FIG. 2, but with the header connector in assembled condition.

More particularly, and referring to FIGS. 2–4, header connector 22 includes a conductive housing, generally designated 26, which, in the preferred embodiment, is a unitary die-cast metal component, such as of zinc alloy. The housing includes a top wall **26*a*, a bottom wall 26*b*, a pair of side walls 26c and 26d and a front wall 26e, all of which combine to define an interior cavity 28 for mating with receptacle connector 24, as described hereinafter. Cavity 28 includes a pair of cavity openings 30 in front wall 26e for receiving a pair of signal terminals as described hereinafter, and a center cavity opening 32** for receiving a ground terminal, also as described hereinafter.

A pair of ground clips, generally designated 34, are mounted on header connector housing 26 within slot means 36 whereby the ground clips are in direct engagement with the conductive housing. The ground clips are readily assembled into the slot means through side wall 26d of the housing. Specifically, each ground clip includes a pair of tail portions 34a which project from front wall 26e of housing 26, as best seen in FIG. 4. The tails are adapted for insertion into holes in a printed circuit board, whereby the tails can be press-fit or soldered to ground traces on the board or in the hole. Each ground clip 34 also has a cantilevered spring arm 34b which is biased into direct engagement with interior wall means of slot means 36 to establish a good conductive interengagement with housing 26. Therefore, ground commoning is effected between the ground traces on a printed circuit board and conductive housing 26 through ground clips 34.

Header connector 22 further includes a pair of signal terminals, generally designated 38, and a ground terminal, generally designated 40. It can be seen in FIGS. 3 and 4 that the signal and ground terminals are oriented in a generally planar array, with the ground terminal located between the signal terminals. All of the terminals, along with ground clips 34, are fabricated as stamped and formed metal components.

Each signal terminal 38 includes a terminal pin 38a projecting into cavity means 28 of housing 26 and tails 38b which project from front wall 26e of the housing. Terminals pins 38a are adapted for interconnection with signal terminals of receptacle connector 24, as described hereinafter. Tails 38b are adapted for insertion into holes in a printed circuit board whereby the tails can be press-fit or soldered to signal traces on the board or in the holes.

Likewise, ground terminal 40 includes a terminal pin 40a projecting into cavity means 28 of housing 26 and a tail 40b projecting from front wall 26e of housing 26. Like signal terminal pins 38, terminal pin 40a is adapted for interconnection with a ground terminal of receptacle connector 24, as described hereinafter. Tail 40b is adapted for insertion into a hole in the printed circuit board for press-fit or soldering to a ground circuit trace on the board or in the hole. The ground terminal has an intermediate body portion 40c which is press-fit into notches 42 (see FIG. 2) so that the ground terminal establishes good conductivity with conductive housing 26.

As best seen in FIGS. 2 and 4, each signal terminal 38 is molded, along a portion of the terminal intermediate its ends, by an insulating mounting body 44, such as of plastic material or the like. The bodies are shaped and configured to be press-fit into openings 30 in front face 26e of housing 26. The insulating bodies insulate the signal terminals from the conductive housing, with terminal pins 38a projecting into cavity means 28 of the housing and tails 38b projecting outwardly from front wall 26e of the housing.

From the foregoing, it can be seen that signal terminals 38, particularly their terminating pins 38a, are completely surrounded by conductive or ground structure and are separated by ground terminal 40, particularly the terminal pin 40a thereof. Specifically, as seen best in FIG. 4, the planar array of signal terminal pins, particularly the terminal pins thereof, are bounded on the top by top wall 26a of housing 26, are bounded on the bottom by bottom wall 26b of the housing, are bounded on opposite sides by side walls 26c and 26d of the housing, and the signal terminals are separated by ground terminal 40. The ground terminal limits cross-talk between the signal terminals and the housing completely surrounds and shields and contains the terminal array.

FIGS. 9–12 show an alternate embodiment of a header connector which has been generally designated 22'. Header connector 22' is similar to header connector 22 except for the modular construction of the signal and ground terminals and their mounting on the housing. Consequently like numerals have been applied in FIGS. 9–12 corresponding to like components or structure described in relation to header connector 22 described in FIGS. 2–4.

Figure 12:
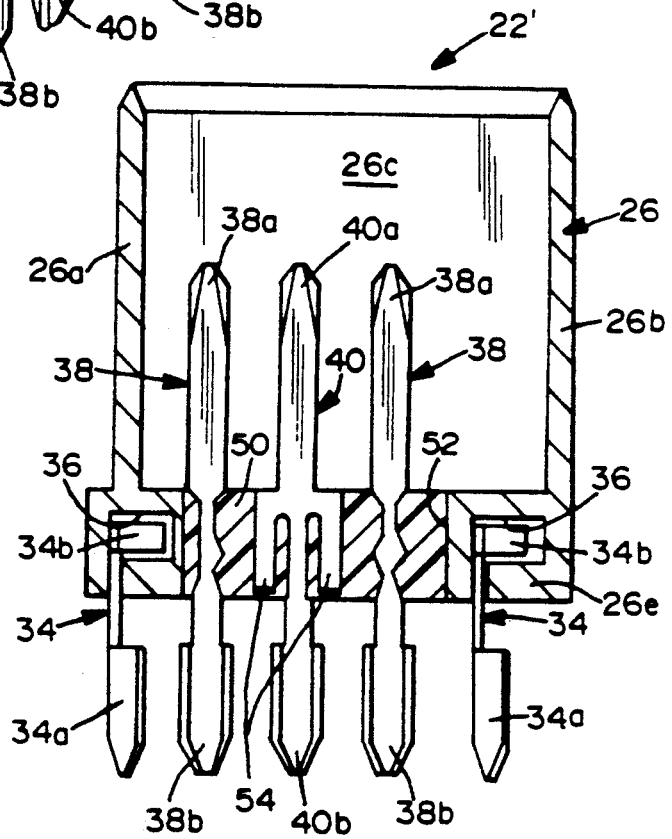
FIG. 12 is a vertical section taken generally in the direction of line 12—12 of FIG. 11.
Figure 13:
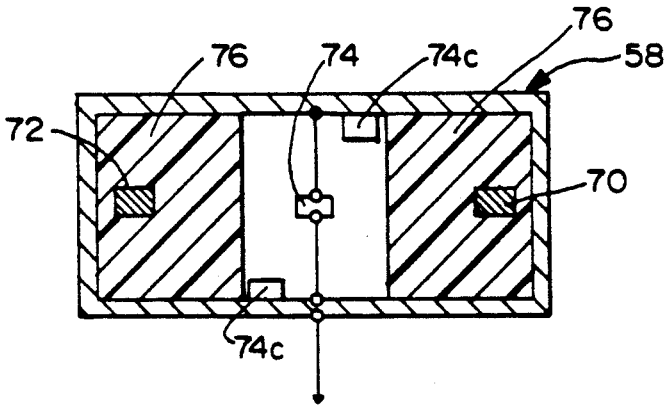
FIG. 13 is a schematic representation of a vertical section of the connector shown in FIG. 6 illustrating the guarded cavity concept.

For instance, header connector 22' includes a conductive housing, generally designated 26, of die-cast metal material, such as zinc alloy. The housing includes a top wall 26a , a bottom wall 26b , a pair of side walls 26c and 26d and a front wall 26e (FIG. 12). Likewise, a pair of ground clips 34, including tail portions 34a and cantilevered spring arm portions 34b, are mounted in slot means 36 of the housing. The connector includes a pair of signal terminals 38 and a ground terminal 40, again with the terminals arranged in a generally planar array. Up to this point, header connector 22', along with its conductive housing, the signal terminals, the ground terminal and the ground clips, is constructed and functions the same as header connector 22 (FIGS. 2–4) and will not be repeated.

Figures 9, 10:
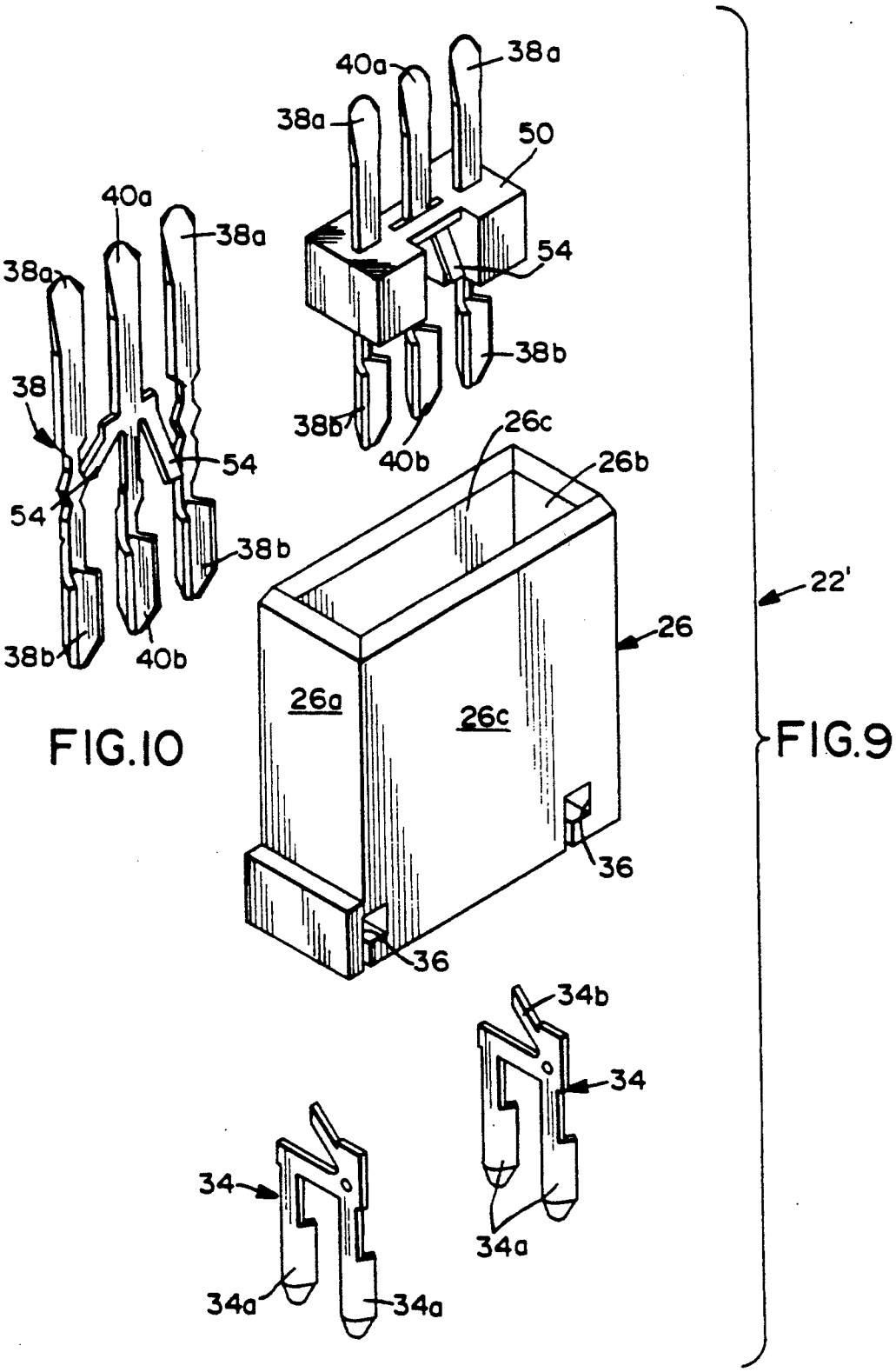
FIG. 9 is an exploded perspective view of an alternate embodiment of the header connector (i.e. versus the embodiment of FIGS. 2–4)
FIG. 10 is a perspective view of the planar array of signal and ground terminals of the header connector of FIG. 9.
Figure 11:
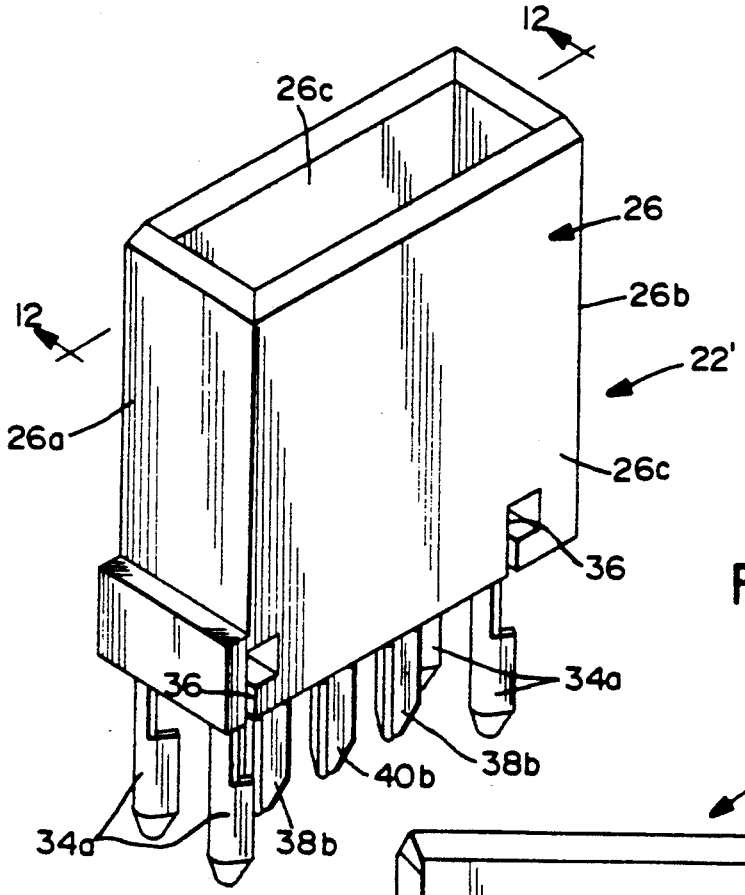
FIG. 11 is a perspective view of the header connector of FIG. 9, in assembled condition.

The principal difference between the construction of header connector 22' versus header connector 22 is that signal terminals 38 and ground terminal 40 are all insert molded across their intermediate portions by a single insulating mounting body 50, as best seen in FIG. 9. Therefore, a single module is provided for mounting all three terminals within a single cavity opening 52 through front wall 26e of conductive housing 26. In order to common ground terminal 40 to conductive housing 26 of header connector 22', the ground terminal has a pair of oppositely directed cantilevered spring arms 54 which bias against side walls of cavity opening 52 of the housing. In other words, the cantilevered spring arms project outwardly of insulating mounting body 50 for direct engagement against adjacent areas of the conductive housing. In assembly, the entire terminal array, thereby, can be inserted into the single cavity opening 52 in the front wall of the housing.

Figure 8:
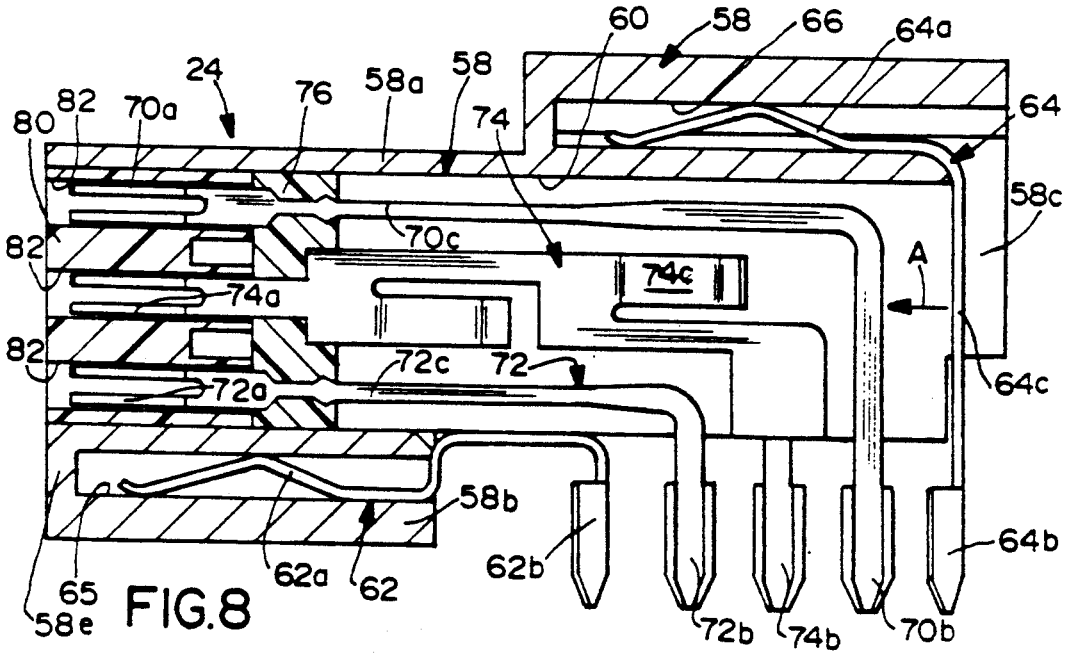
FIG. 8 is a vertical section through the receptacle connector, taken generally along line 8—8 of FIGS. 1, 5 or 7.
Figure 7:
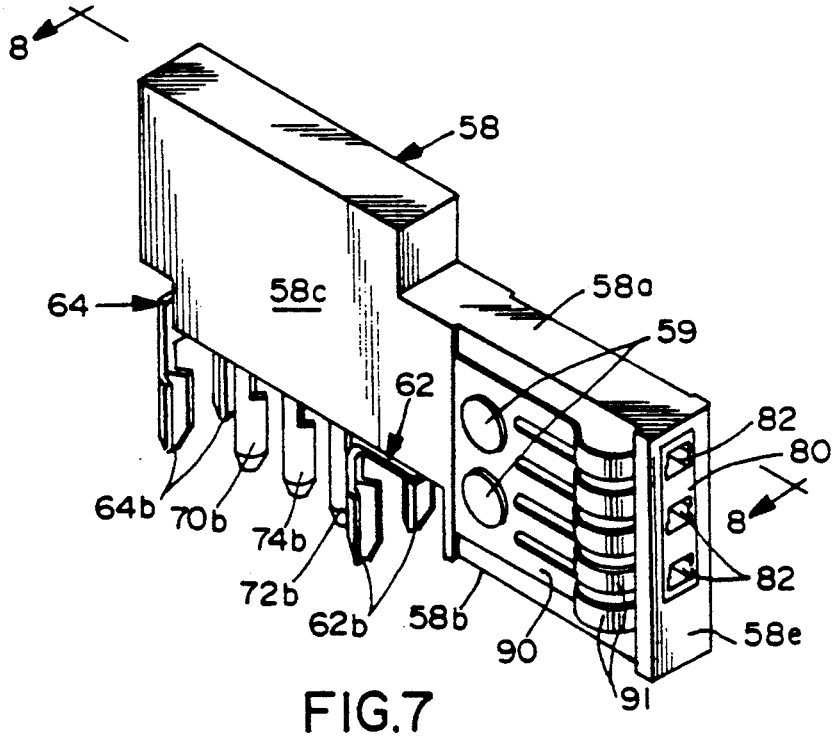
FIG. 7 is a perspective view of the receptacle connector of the assembly show in FIG. 6.
Figure 6:
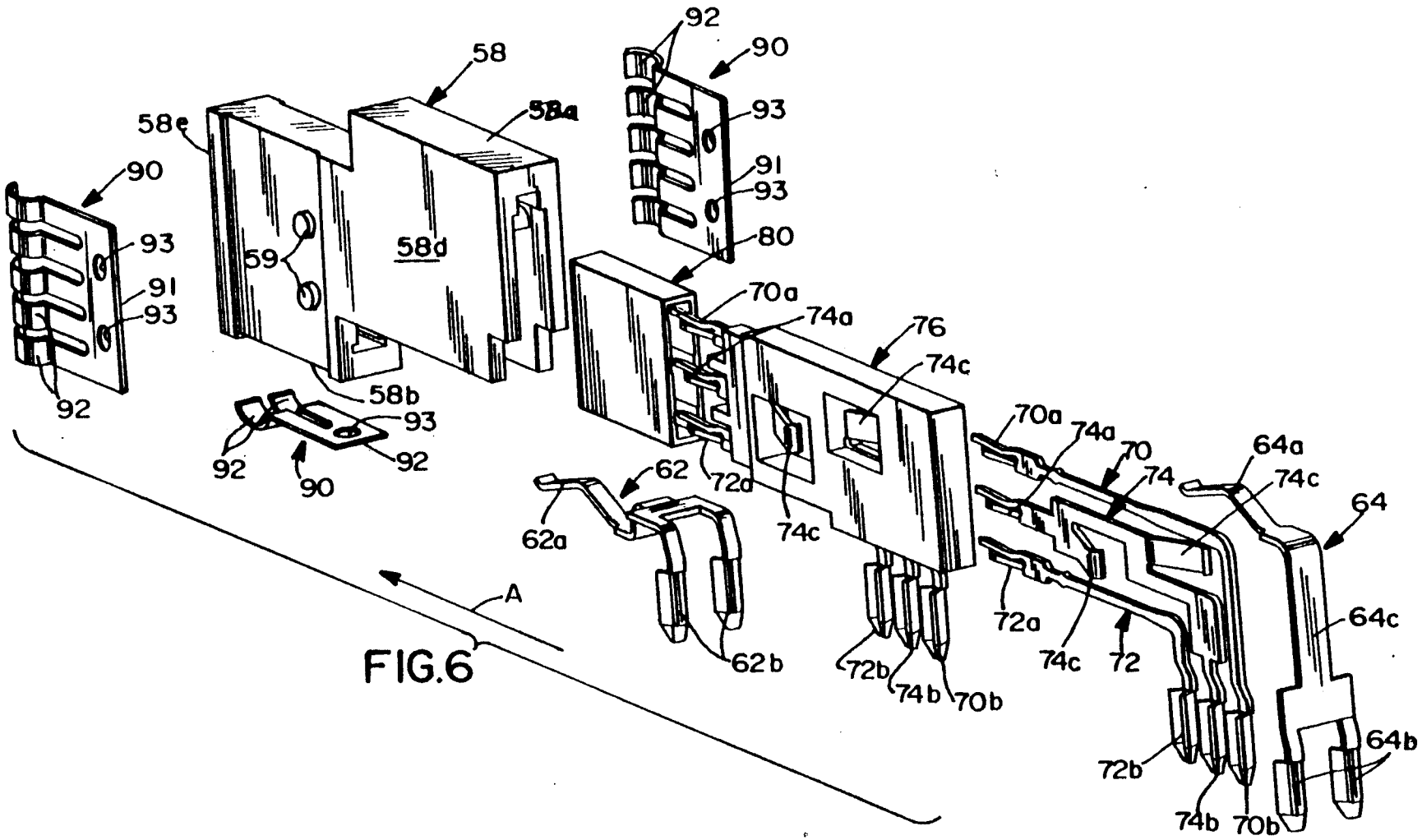
FIG. 6 is an exploded perspective view of the components of the receptacle connector.

Referring to FIGS. 6–8 in conjunction with FIG. 1, receptacle connector 24 is constructed and functions very similar to header connectors 22 and 22'. In particular, the receptacle connector is a right-angled connector and includes a conductive housing, generally designated 58, which includes a top wall 58a, a bottom wall 58b, a pair of side walls 58c and 58d and a front wall 58e. The walls define an interior cavity means 60. The housing is unitarily constructed as a die-cast metal component, such as of zinc alloy.

Like header connectors 22 and 22', receptacle connector 24 includes a pair of ground clips, generally designated 62 and 64, for commoning the housing to ground traces on a printed circuit board. Specifically, ground clip 62, as best seen in FIG. 8, includes a spring leg portion 62*a* and a tail portion 62*b* which projects generally at a right-angle to the spring leg portion. The spring leg portion is force-fit into a recess 65 in an enlarged portion of conductive housing 58 at the bottom thereof immediately behind front wall 58*e* of the housing. Ground clip 64 similarly includes a spring leg portion 64*a* and a tail portion 64*b*. Like ground clip 62, ground clip 64 is generally L-shaped with spring leg portions 64*a* force-fit into a recess 66 in conductive housing 58 projecting from top wall 58 of the housing at the rear thereof. With the above described construction of ground clips 62 and 64, it can be understood that the spring leg portions 62*a* and 64*a* establish a direct conductive engagement with conductive housing 58. Tail portions 62*b* and 64*b* of spring clips 62 and 64, respectively, are adapted for insertion into holes in a printed circuit board for press-fit or soldering to ground traces on the board or in the holes.

Like header connectors 22 and 22', receptacle connector 24 includes a pair of signal terminals and a ground terminal which are in a generally planar array. This is seen best in FIGS. 6 and 8. With receptacle connector 24 being a right-angled connector, the terminals appropriately are generally L-shaped, as shown.

More particularly, receptacle connector 24 includes a pair of signal terminals, generally designated 70 and 72, with a ground terminal, generally designated 74, disposed therebetween and within the generally planar array. Signal terminals 70 and 72 include female terminating portions 70*a* and 72*a*, respectively, and tail portions 70*b* and 72*b*, respectively. The female terminating portions are adapted for engagement with terminating pins 38*a* of signal terminals 38 of either header connector 22 or header connector 22'. Tail portions 70*b* and 72*b* are adapted for insertion into appropriate holes in a printed circuit board for press-fit or soldering to signal circuit traces on the board or in the holes.

Figure 14:
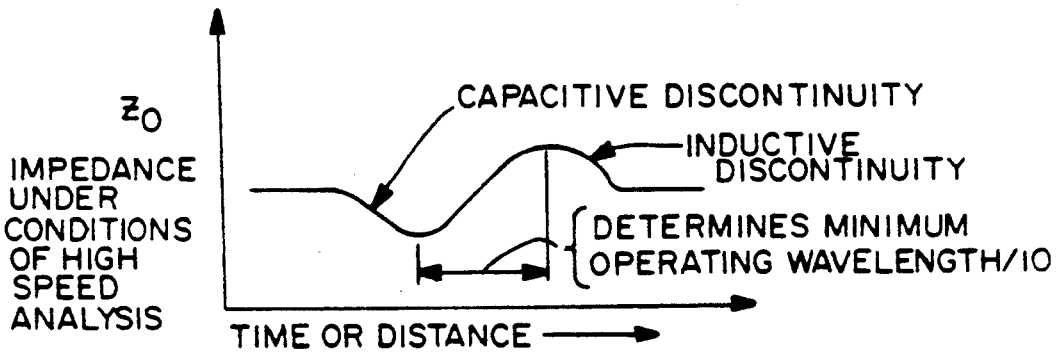
FIG. 14 is an analytical schematic representation of the impedance an electrical signal which is much higher than the intended application frequency sees traveling through a connector with a corrective discontinuity.
Figure 15:
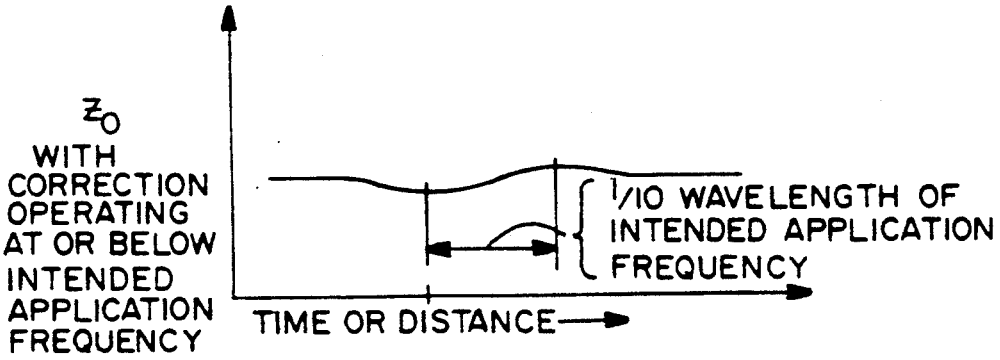
FIG. 15 is schematic representation of the impedance an electrical signal sees traveling through a connector with terminals made in accordance with the subject invention and operating at the intended application frequency or below.

As best seen in FIG. 8, female terminating portions 70*a* and 72*a* are followed by reduced width terminal sections 70*c* and 72*c*, respectively. Each reduced width section is of a predetermined width and is located following the female terminal portion by approximately 1/10 of the shortest wavelength of an electrical signal expected to be transmitted along the terminal. Each reduced section creates an inductive discontinuity which compensates for a capacitive discontinuity created by the preceding female terminal portion and in this fashion the two discontinuities are seen by an electrical signal traveling along a terminal as self-canceling as long as the signal's wavelength is not less than the wavelength used to calculate the distance for location of the reduced width section. The width of the reduced section can be calculated by methods well known in the art or by empirical means. FIGS. 14 and 15 illustrate an electrical representation relationship of the two discontinuities an electrical signal sees traveling through the connector assembly.

Ground terminal 74 includes a female terminating is portion 74*a* and a tail portion 74*b*. The female terminating portion is adapted for interconnection with terminating pin portion 40*a* of either ground pin 40 or 40' of either header connectors 22 or 22', respectively. Tail portion 74*b* is adapted for insertion into an appropriate hole in a printed circuit board for press-fit or soldering to a ground trace on the board or in the hole. Lastly, ground terminal 74 includes a pair of cantilevered spring arm portions 74*c* projecting outwardly from opposite sides thereof. The cantilevered spring arm portions are adapted for directly engaging wall means of conductive housing 58, as described hereinafter.

Like header connector 22', all of signal terminals 70 and 72 and ground terminal 74 of receptacle connector 24, are insert molded about their intermediate areas by a single insulating mounting body 76, as best seen in FIG. 6. With the receptacle connector being a rightangled connector, female terminating portions 70*a*, 72*a* and 74*a* of signal terminals 70 and 72 and ground terminal 74, respectively, project forwardly of insulating body 76, and tail portions 70*b*, 72*b* and 74*b* project out of the bottom of the insulating mounting body. It can be seen in FIG. 6 how cantilevered spring arms 74*c* of ground terminals 74 project outwardly beyond the bounds of the insulating body so that the spring arms can directly engage conductive housing 58 to establish a direct ground commoning therebetween.

Because female terminating portions 70*a*, 72*a* and 74*a* are adapted to resiliently engage the terminal pins of the header connectors, insert molded body 76 is not inserted about these relatively movable components. Consequently, a unitarily molded, insulating housing insert 80 is provided for insertion into the front of cavity means 60, as best seen in FIG. 8. The female terminating portions project into through holes 82 in the housing insert, and the holes are sufficiently oversized in a transverse direction to allow flexing of the female terminating portions.

In assembly, and referring particularly to FIG. 8, housing insert 80 is positioned in the front end of cavity means 60 of housing 58 of receptacle connector 24. With signal terminals 70 and 72, along with ground terminal 74, being insert molded by insulating mounting body 76, a terminal module is provided for assembling all of the terminals simultaneously into the housing in the direction of arrow "A". Before the terminal module is assembled, lower ground clip 62 is assembled as shown. After the terminal module is assembled, ground clip 64 is assembled to the position shown in FIG. 8. It can be seen that a leg portion 64*c* of ground clip 64 extends downwardly and completely covers the open area at the rear of the housing behind the terminal array, i.e., behind signal terminal 70. This elongated leg of ground clip 64 shields the terminal array at the rear of the housing. As described above in relation to header connector 22, signal terminals 70 and 72 of receptacle connector 24 are substantially entirely shielded thereabout and are separated by ground terminal 74. The ground terminal limits cross-talk between the signal terminals. The top, bottom and side walls of conductive housing 58 shield the terminal array, and leg 64*c* of ground clip 64 shields the terminal array at the open rear end of the housing.

Lastly, as shown in FIGS. 6 and 7, when header connector 22 (or header connector 22') and receptacle connector 24 are assembled, a conductive grounding gasket 90 may be disposed between the connectors (i.e. between the connector housings) . The conductive grounding gasket 90 is made up of two substantially identical portions 91 mounted on walls 58*c* and 58*d* of the receptacle housing 58 and a portion 92 which is mounted on the bottom wall 58*b* of the housing. Each gasket portion may be stamped from a strip of beryllium copper and include one or more formed resilient fingers 92 extending from one of its sides. A pair of apertures 93 are stamped in portions 91 and one in portion 92 which are of a size such that they can be pressfit over projections 59 extending from walls 58*b*, 58*c* and 58*d*, respectively, thereby fastening the gasket portions to the receptacle housing. The conductive grounding gasket commons the conductive housings of the connectors when the connectors are assembled. Consequently, not only do the individual housings of the respective connectors establish a primary ground reference for the respective connector, but, with grounding gasket 90 commoning the connector housings, the entire connector assembly is provided with a primary ground reference established by the assembled housings.

Figure 5:
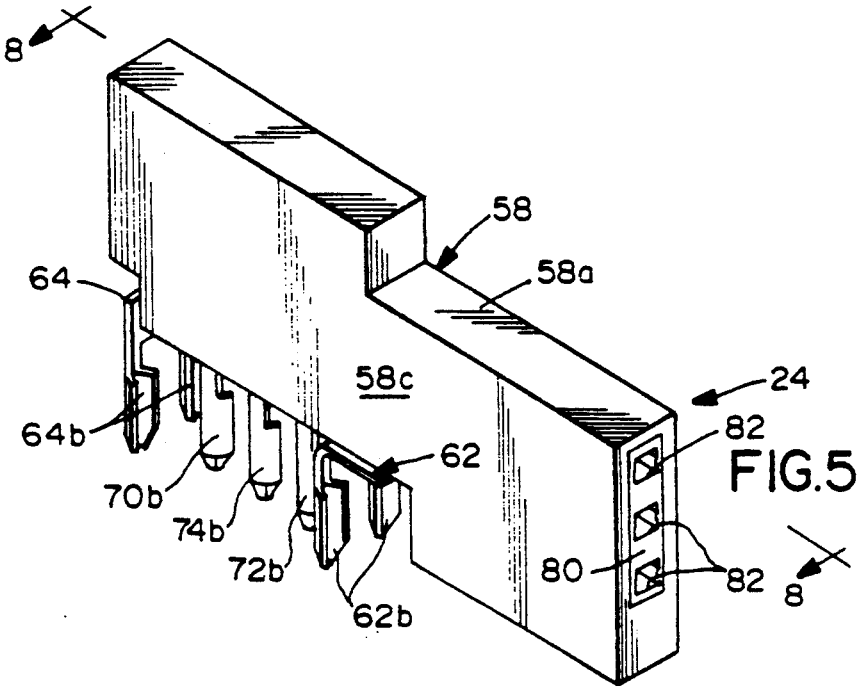
FIG. 5 is a perspective view of the receptacle connector (without a ground gasket) of the assembly, looking in the opposite direction as the perspective view of FIG. 1.

It is conceivable that in some applications a grounding gasket may not be required for containment of electromagnetic energy and the receptacle housing 58 may be constructed as shown in FIG. 5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical signal connector, comprising a conductive housing having cavity means for receiving at least two signal terminals and at least one ground terminal, at least one signal terminal being molded at least in part in an insulating mounting body to provide a module for mounting in the cavity means to insulate the terminal from the conductive housing, the ground terminal being in direct conductive engagement with the housing, the terminals comprising stamped and formed metal components, and including at least one ground clip mounted on the conductive housing in direct conductive engagement therewith and adapted for commoning to a ground on a respective backplane and daughter printed circuit board, whereby the housing establishes a primary ground reference for the connector.

2. The electrical signal connector of claim 1, wherein the two signal terminals are arranged with the ground terminal therebetween, and two said ground clips are arranged with one ground clip outside each signal terminal, thereby to substantially shield the signal terminals.

3. The electrical signal connector of claim 1, including two said signal terminals each respectively molded in an insulating mounting body.

4. The electrical signal connector of claim 1, wherein the two signal terminals and the ground terminal all molded in a common insulating body, the ground terminal having a portion projecting beyond the body for engaging a wall of the housing..

5. The electrical signal connector of claim 4 wherein said portion of the ground terminal comprises a cantilevered spring arm.

6. The electrical signal connector of claim 1 wherein said housing comprises a die-cast metal component.

7. The electrical signal connector of claim 1 wherein said housing is configured as a right-angled connector having an open side through which the terminals are assembled, with the terminals projecting from an opposite side of the housing, said ground clip being configured and located on the housing to close said open side.

8. A method of fabricating an electrical signal connector which includes a housing, at least one signal terminal, at least one ground terminal and at least one ground clip, comprising:

fabricating said housing of conductive material with a cavity means;

forming said terminals as stamped and formed metal components;

molding a portion of at least the signal terminal within an insulating mounting body to provide a module;

assembling said module and the ground terminal in the cavity means of the housing, with the ground terminal in direct conductive engagement with the housing; and mounting the ground clip in the housing in direct conductive engagement therewith.

9. The method of claim 8, wherein the connector includes two said signal terminals and one ground terminal, the method comprising molding portions of at least the two signal terminals in separate insulating mounting bodies to provide a pair of modules, and assembling the modules and the ground terminal in the cavity means of the housing with the ground terminal between the modules.

10. The method of claim 8, wherein the connector includes two said signal terminals and one ground terminal, all of the terminals being molded in a common insulating body, with the ground terminal being disposed between the signal terminals, and assembling the terminals simultaneously by assembling the common insulating body into the cavity means of the housing.

11. An electrical signal connector device, comprising at least one conductive signal means having opposite ends adapted for interconnection with other circuit elements, a ground conductive means having opposite ends adapted for mating with the other circuit elements, intermediate portions of the signal conductive means and the ground conductive means being integral with dielectric means, and conductive shielding means substantially surrounding the conductive means, with the dielectric means insulating the signal conductive means from the shielding means.

* * * * *